US008432317B2

(12) United States Patent
Chen

(10) Patent No.: US 8,432,317 B2
(45) Date of Patent: Apr. 30, 2013

(54) ANTENNA MODULE

(75) Inventor: Hsi-Chieh Chen, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 279 days.

(21) Appl. No.: 12/862,786

(22) Filed: Aug. 25, 2010

(65) Prior Publication Data

US 2012/0001827 A1 Jan. 5, 2012

(30) Foreign Application Priority Data

Jun. 30, 2010 (TW) ..... 99121605

(51) Int. Cl.
*H01Q 5/00* (2006.01)

(52) U.S. Cl.
USPC ..... 343/700 MS; 343/702; 343/846; 343/895

(58) Field of Classification Search ..... 343/700 MS, 343/846, 702, 745–748, 829, 830; 29/600, 29/592.1, 832, 840–842
See application file for complete search history.

(56) References Cited

U.S. PATENT DOCUMENTS 7,498,992 B2 * 3/2009 Hung et al. ..... 343/702
8,051,550 B2 * 11/2011 Cheng et al. ..... 29/600

* cited by examiner

*Primary Examiner* — Shawki Ismail
*Assistant Examiner* — Christopher Lo
(74) *Attorney, Agent, or Firm* — Altis Law Group, Inc.

(57) ABSTRACT

An antenna module for a portable device includes a first antenna section, a second antenna section, a third antenna section, a feed section, and a ground section. The first antenna section and the third antenna section form a first groove. The feed section and the ground section are parallel to each other. The first antenna section and the second antenna section jointly connect with the feed section.

16 Claims, 3 Drawing Sheets

ANTENNA MODULE

BACKGROUND

1. Technical Field

The present disclosure relates to an antenna module for a portable device.

2. Description of Related Art

Portable devices such as mobile phones, personal digital assistants (PDA) and laptop computers are widely used. Antennas are installed in such portable devices to receive/send wireless signals. Generally, the antennas may receive/send wireless signals of different frequencies (e.g., DCS1800, PCS1900, UMTS2100, etc.), requiring that the antennas be multiband antennas.

However, most multiband antennas have complicated structures and are large, compromising most current portable devices having insufficient space to install the multiband antennas. Even if some miniaturized multiband antennas can be installed in the portable devices, they are difficult to install precisely, and communication quality of the portable devices may be affected.

BRIEF DESCRIPTION OF THE DRAWINGS

Aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding sections throughout the figures.

DETAILED DESCRIPTION

Figure 1:
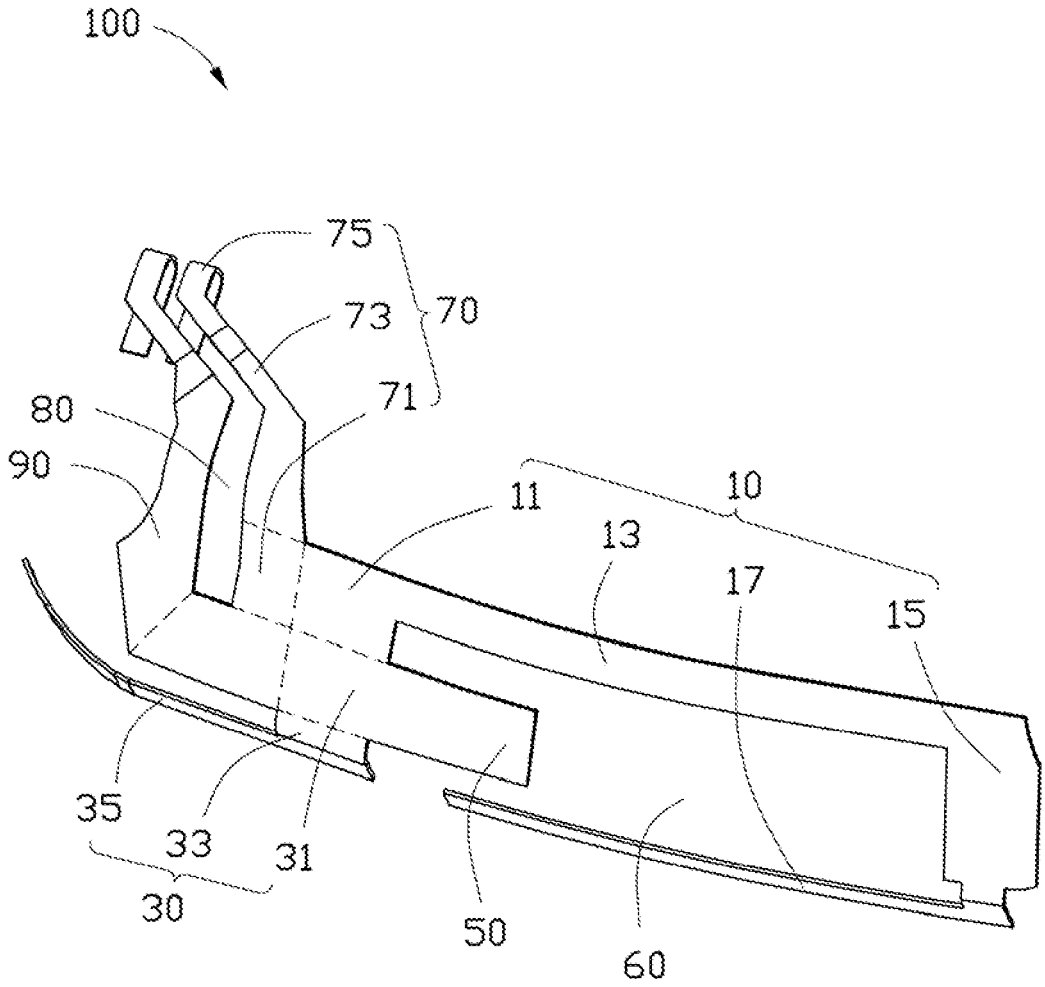
FIG. 1 is a schematic view of one embodiment of an antenna module from a first perspective.
Figure 2:
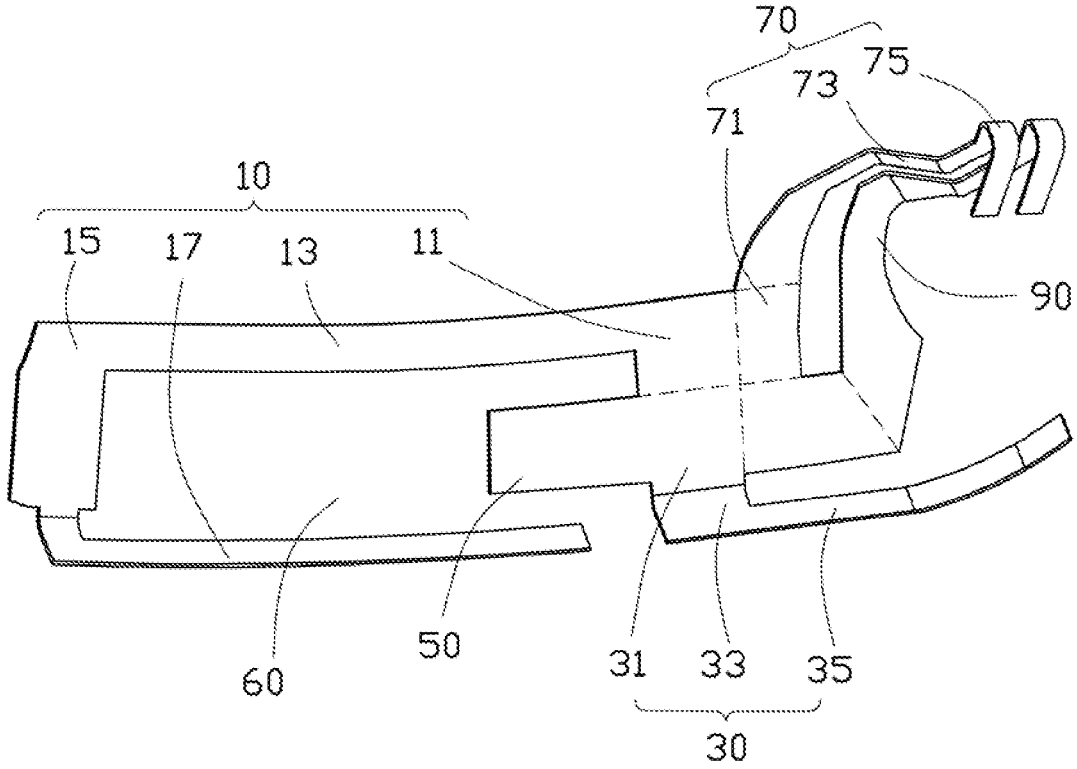
FIG. 2 is a schematic view of one embodiment of the antenna module of FIG. 1 from a second perspective.

FIGS. 1 and 2 are schematic views of an antenna module 100 for a portable device (not shown), from a first perspective and a second perspective, respectively. The portable device may be a mobile phone, a personal digital assistant (PDA), or a laptop computer, for example. In the embodiment, the portable device is a mobile phone. The antenna module 100 is installed in the portable device to receive/send wireless signals.

The antenna module 100 is made of flexible printed circuit (FPC) and includes a first antenna section 10, a second antenna section 30, a third antenna section 50, a feed section 70, and a ground section 90. The first antenna section 10 and the second antenna section 30 are connected to the same side of the third antenna section 50. The feed section 70 and the ground section 90 are both connected to the first antenna section 10 and the second antenna section 30.

The first antenna section 10 is a resonant antenna and includes an initial section 11, a first electric connecting section 13, a second electric connecting section 15, and a bent section 17. The initial section 11, first electric connecting section 13, and second electric connecting section 15 are coplanar and the bent section 17 is not. The initial section 11 is a rectangular thin body. The first electric connecting section 13 is a strip connected to an end of the initial section 11, and extends perpendicular to the end. The second electric connecting section 15 is substantially a rectangular thin body connected to an end distal to the initial section 11 of the first electric connecting section 13, and extending substantially perpendicular to the first electric connecting section 13. The bent section 17 is a substantially L-shaped strip, smaller than the first electric connecting section 13, connected and bent at a middle portion of an end distal to the first electric connecting section 13 of the second electric connecting section 15, and extending toward the initial section 11. The initial section 11 is shorter than the second electric connecting section 15 and disposed opposite thereto. The first electric connecting section 13 is longer than the bent section 17 and disposed opposite thereto.

The second antenna section 30 is a resonant antenna and includes a connecting section 31, a transient section 33, and an extending section 35. The connecting section 31 is a rectangular thin body, substantially the same size of the initial section 11, connected to an end proximal to the first electric connecting section 13 of the initial section 11 and coplanar therewith. The transient section 33 is a rectangular thin body connected and bent at an end distal to the initial section 11 of the connecting section 31 and coplanar therewith. The extending section 35 is a curved thin body connected to an end distal to the connecting section 31 of the transient section 33, and extending away from the bent section 17.

The third antenna section 50 is substantially a rectangular thin body serving as resonant antenna, and substantially the same size of the connecting section 31. The third antenna section 50 is connected to an end of the connecting section 31 and extended toward the second electric connecting section 15, parallel with the first electric connecting section 13. The third antenna section 50 is shorter than the first electric connecting section 13. The third antenna section 50 and the first antenna section 10 cooperatively form a groove 60. In the embodiment, the groove 60 is substantially U-shaped.

The feed section 70 includes a joining section 71, a winding section 73, and a feed end 75. The joining section 71 is substantially coplanar with the initial section 11 and connected to an end to the first electric connecting section 13 thereof. The winding section 73 is bent back and forth at an end distal to the extending section 35 of the joining section 71, and extending away from the joining section 71. The feed end 75 is substantially U shaped and bent at an end of the winding section 73. The feed end 75 connects to a conducting wire (not shown) of the portable device to provide system signals for the antenna module 100.

The ground section 90 is the same shape of the joining section 71 and connected to the connecting section 31 and the joining section 71. The ground section 90 is disposed outside the feed section 70 and parallel thereto. The feed section 70 and the ground section 90 form the second groove 80.

The antenna module 100 can be installed on the exterior surface of the portable device (not shown) to conserve space. It is understood that an angle between the bent section 17 and second electric connecting section 15, and between the transient section 33 and the connecting section 31, and a shape of the bent section 17, the extending section 35, the feed section 70, and the ground section 90 are adjustable according to a housing of the portable device.

Variation of combinations of first antenna section 10, the second antenna section 30, and the third antenna section 50 cause different signal transmission lengths. As a result, the antenna module 100 is operable to generate signals of different resonant frequencies in responding to the different signal transmission lengths. For example, the antenna module 100 can be operative at different communication standards, GSM850 (bandwidths of about 824-894 MHz), EGSM900 (bandwidths of about 880-960 MHz), DCS1800 (bandwidths of about 1710-1880 MHz), PCS1900 (bandwidths of about 1850-1990 MHz), WCDMA2100 (bandwidths of about 1920-2170 MHz), WCDMA II (bandwidths of about 1850-1990 MHz), WCDMA V (bandwidths of about 824-894 MHz), WCDMA VIII (bandwidths of about 880-960 MHz).

Figure 3:
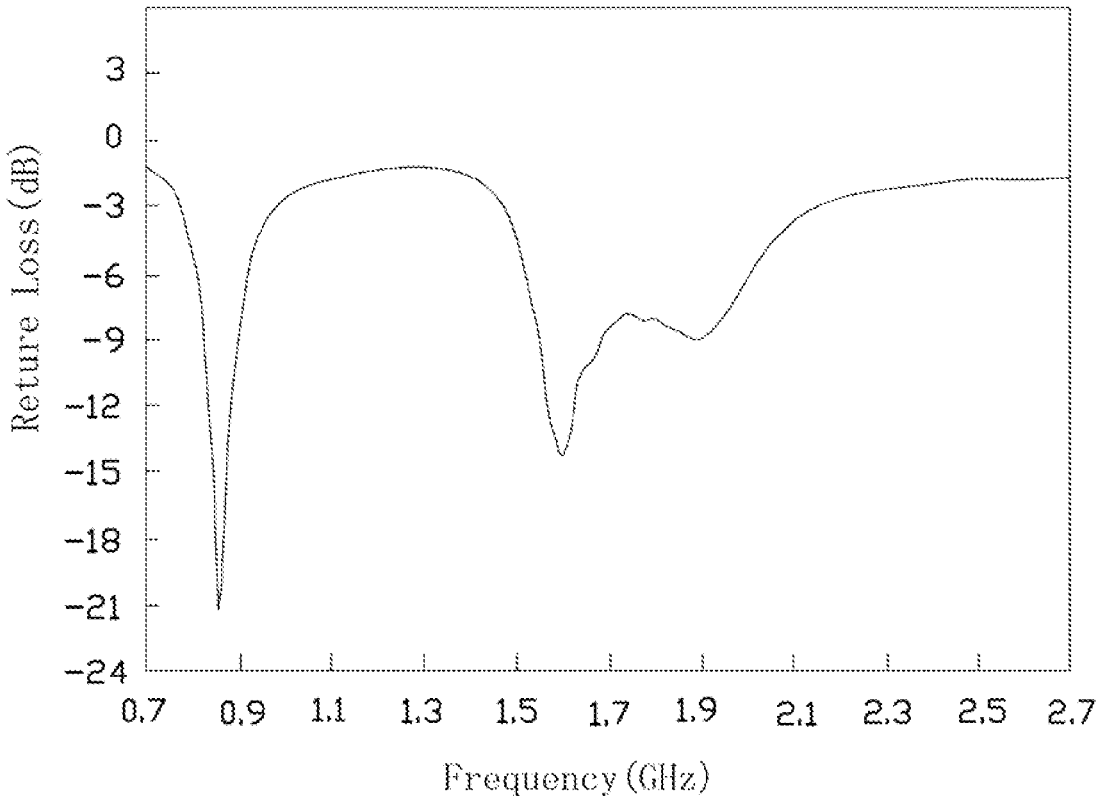
FIG. 3 is one embodiment of a measurement diagram of the antenna module of FIG. 1.

FIG. 3 is a measurement diagram of return loss of the antenna module 100 of FIG. 1. The values of return loss −5.2 db, −5.8 db, −8 db, and −4.1 db respectively correspond to 824 MHz, 960 MHz, 1710 MHz, and 2170 MHz and satisfy the communication standards.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent, indicated by the broad general meaning of the terms in which the appended claims are expressed.

What is claimed is:

1. An antenna module, comprising:

a first antenna section, the first antenna section comprising:

an initial section;

a first electric connecting section, the first electric connecting section substantially extending perpendicular from an end of the initial section;

a second electric connecting section, the second electric connecting section substantially extending perpendicular from an end of the first electric connecting section and parallel to the initial section; and a bent section bent at an end of the second electric connecting section opposite to the first electric connecting section and extending toward the initial section;

a second antenna section and a third antenna section jointly connecting with the first antenna section on the same side; and wherein the first antenna section and the third antenna section form a first groove;

a feed section and a ground section parallel to each other and form a second groove;

wherein the first antenna section and the second antenna section jointly connect with the feed section.

2. The antenna module of claim 1, wherein the initial section, the first electric connecting section, the second electric connecting section are coplanar with each other and are not coplanar with the bent section.

3. The antenna module of claim 2, wherein the second antenna section comprises a connecting section, a transient section, and an extending section, the connecting section linearly extends from an end of the initial section, the transient section is bent at an end of the connecting section, the extending section extends from a side of the transient section opposite to the bent section.

4. The antenna module of claim 3, wherein the connecting section is coplanar with the initial section, the extending section is coplanar and collinear with the bent section.

5. The antenna module of claim 3, wherein the third antenna section extends from an end of the connecting section toward the second electric connecting section, the third antenna section is coplanar with the first antenna and parallel with the first electric connecting section, and cooperatively forms the first groove with the first antenna section.

6. The antenna module of claim 5, wherein the first groove is substantially U-shaped.

7. The antenna module of claim 6, wherein the feed section comprises a joining section, a winding section and a feed end, wherein the joining section connects to an end opposite to the first electric connecting section of the initial section, wherein the winding section connects to an end distal to the initial section of the joining section and to a conducting wire of a portable device to provide system signals for the antenna module.

8. The antenna module of claim 7, wherein the ground section connects to the joining section and connecting section, and is the same shape of the feed section.

9. The antenna module of claim 1 is made of flexible printed circuits.

10. An antenna module, comprising:

a first antenna section, the first antenna section comprising:

an initial section;

a first electric connecting section, the first electric connecting section substantially extending perpendicular from an end of the initial section;

a second electric connecting section, the second electric connecting section substantially extending perpendicular from an end of the first electric connecting section and parallel to the initial section; and a bent section bent at an end of the second electric connecting section opposite to the first electric connecting section and extending toward the initial section;

a second antenna section and a third antenna section jointly connecting with the first antenna section on the same side; and a feed section and a ground section parallel to each other; wherein the first antenna section and the second antenna section jointly connect with the feed section.

11. The antenna module of claim 10, wherein the initial section, the first electric connecting section, the second electric connecting section are coplanar with each other and are not coplanar with the bent section.

12. The antenna module of claim 11, wherein the second antenna section comprises a connecting section, a transient section, and an extending section, the connecting section linearly extends from an end of the initial section, the transient section is bent at an end of the connecting section, the extending section extends from a side of the transient section opposite to the bent section.

13. The antenna module of claim 12, wherein the connecting section is coplanar with the initial section, the extending section is coplanar and collinear with the bent section.

14. The antenna module of claim 13, wherein the third antenna section extends from an end of the connecting section toward the second electric connecting section, the third antenna section is coplanar with the first antenna and parallel with the first electric connecting section.

15. The antenna module of claim 14, wherein the third antenna section extends from an end of the connecting section toward the second electric connecting section, the third antenna section is coplanar with the first antenna and parallel with the first electric connecting section.

16. The antenna module of claim 15, wherein the feed section comprises a joining section, a winding section and a feed end, the joining section connects to an end of the initial section opposite to the first electric connecting section, the winding section connects to an end distal of the joining section, the feed end connects to the winding section.

* * * * *